US010839775B2

(12) United States Patent
McClary

(10) Patent No.: US 10,839,775 B2
(45) Date of Patent: Nov. 17, 2020

(54) CAPO FOR STRINGED INSTRUMENTS SUCH AS GUITAR AND BANJO

(71) Applicant: David Warren McClary, Cosby, TN (US)

(72) Inventor: David Warren McClary, Cosby, TN (US)

( * ) Notice: Subject to any disclaimer, the term of this patent is extended or adjusted under 35 U.S.C. 154(b) by 0 days.

(21) Appl. No.: 16/541,236

(22) Filed: Aug. 15, 2019

(65) Prior Publication Data

US 2020/0058274 A1 Feb. 20, 2020

Related U.S. Application Data

(60) Provisional application No. 62/765,050, filed on Aug. 17, 2018.

(51) Int. Cl.
*G10D 3/053* (2020.01)

(52) U.S. Cl.
CPC ..... *G10D 3/053* (2020.02)

(58) Field of Classification Search
CPC ..... G10D 3/043
See application file for complete search history.

(56) References Cited

U.S. PATENT DOCUMENTS 4,475,433 A * 10/1984 Williamson ..... G10D 3/043 84/318
2013/0118334 A1* 5/2013 Stenbroten ..... G10D 3/043 84/318

* cited by examiner

*Primary Examiner* — Kimberly R Lockett

(57) ABSTRACT

Method and apparatus for a capo for a fretted instrument with a plurality of strings. The capo base having been bent into a u-shape, with a barrier of Velcro on the bottom side where the capo contacts on the strings, protecting them, also said Velcro will not let the strings move laterally, out of tune. Having also Velcro on the inside of the rear of the capo to protect the finish on the instruments' side. The capo covers two adjacent frets, pressing the body of the capo to the frets and not to the fretboard, eliminating excessive string sharpness. The capo having a thumbnut on the bottom to tighten the capo down on the strings.

15 Claims, 3 Drawing Sheets

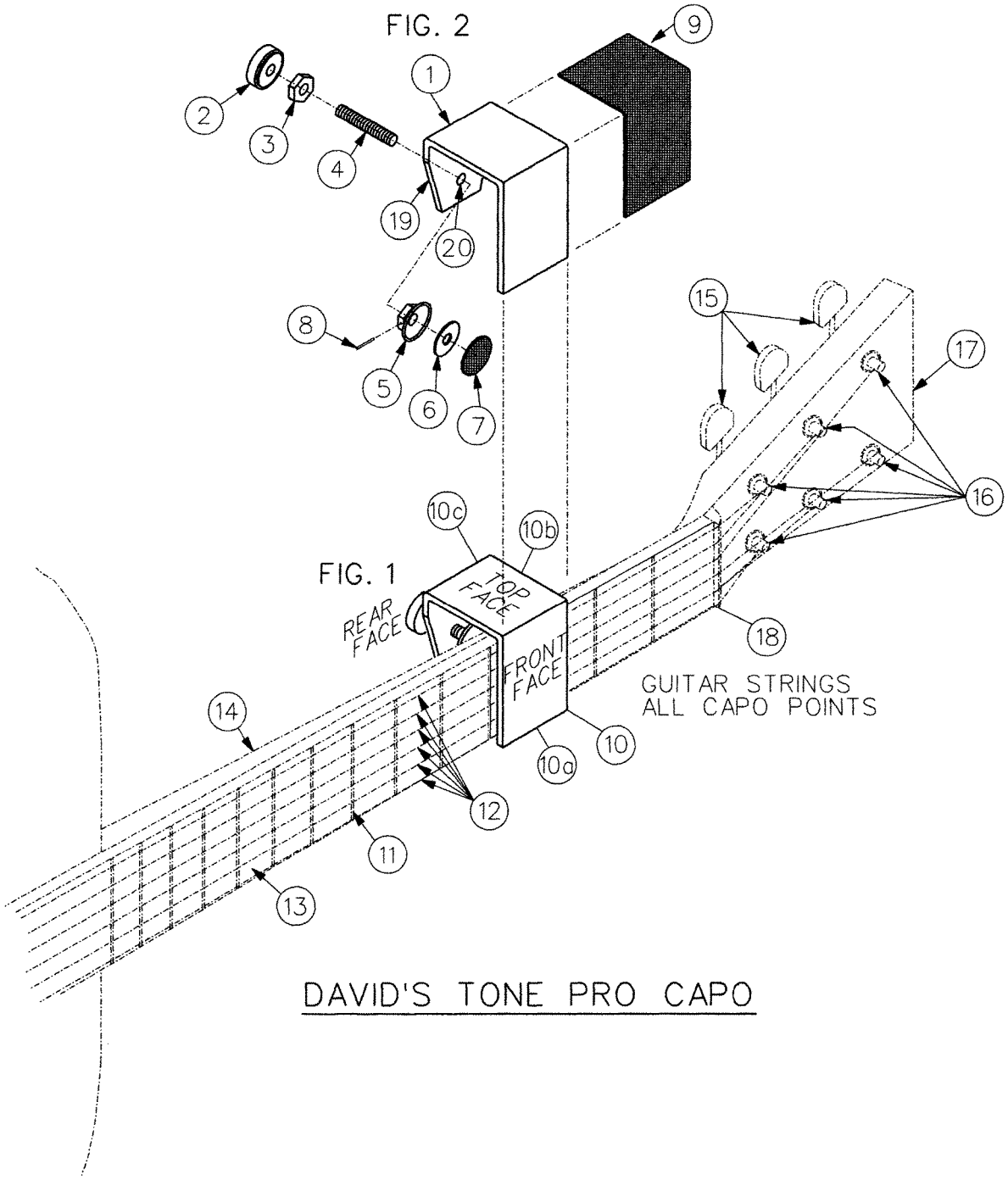
DAVID'S TONE PRO CAPO

BACK VIEW

* DIMENSIONS SHOWN ARE FOR STANDARD GUITAR. DIMENSIONS WILL VARY FOR OTHER INSTRUMENTS (e.g. BANJO)

BOTTOM SIDE

RIGHT SIDE

DAVID'S TONE PRO CAPO

ASSEMBLY DRAWING

DAVID'S TONE PRO CAPO

PARTS LIST DRAWING

CAPO FOR STRINGED INSTRUMENTS SUCH AS GUITAR AND BANJO

BACKGROUND OF INVENTION

Field of the Invention

This present invention generally relegates to a capo for fretted musical instruments, specifically for guitar and banjo.

Description of Related Art

Related devices of prior art come in many designs, but none disclose the unique features of this present invention.

U.S. Pat. No. 4,250,790 Feb. 17, 1981 Shub, disclosed a capo for guitar and banjo. U.S. Pat. No. 7,939,736, B2 Campling, disclosed a guitar capo. U.S. Pat. No. 4,319,512 Mar. 16, 1982 Clyburn, disclosed a guitar capo.

While all these related devices may be suitable for which they were designed, they would not be suitable for the present invention as herein described. The drawings and explanation will show that this invention works in a simplistic and novel way.

BRIEF SUMMARY OF THE INVENTION

The present invention satisfies a need for a capo for use with stringed instruments such as a guitar and a banjo with plurality of strings. The present invention resembles a c-clamp where as the top rest on the strings, covering two frets simultaneously, then is bent on the top rear of the instrument neck at a 90-degree angle downward along the side of the instrument neck, then bent on another 90-degree angle under the neck. The inside of the capo is covered with Velcro, to protect the strings and the wood of the instrument, as well as to not allow the strings to move latterly. On the bottom angle under the instrument neck, there is a knurled thumbnut, bolt, swivel washer and Velcro pad. When this knurled thumbnut is screwed in, the pad contacts the instrument neck, pulling the top of the capo downward on two frets simultaneously.

Accordingly, it is an object of the present invention to provide an improved capo for stringed instruments, such as guitar and banjo.

Another object of this invention is to improve ease and simplicity of use, with one hand simple operation.

Another object of this invention is to eliminate sharp notes by pressing strings to two adjacent frets, not the fret board, which raises the octave of the strings to an unwanted level.

Another object of this invention is to eliminate the issue of strings being pulled latterly, causing strings to be out of tune.

BRIEF DESCRIPTION OF THE DRAWINGS

In order for the invention to be fully understood, it will be described by example, with reference to the accompanying drawings in which:

FIG. 1 is a prospective view of the invention as in use on the stringed instrument neck.

FIG. 2 is an exploded view of the present invention.

DETAILED DESCRIPTION OF THE INVENTION

Figure 3:
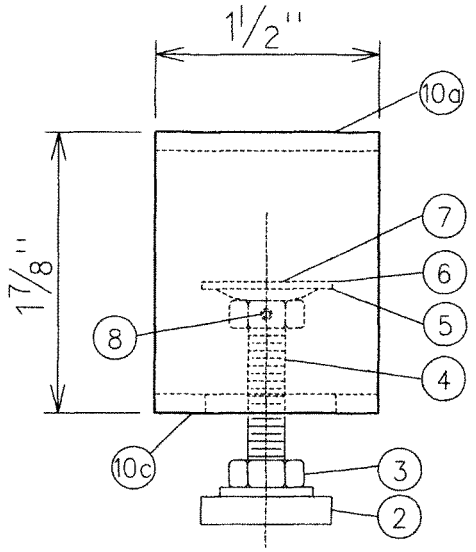
FIG. 3 is a view of the back side of the present invention.
Figure 4:
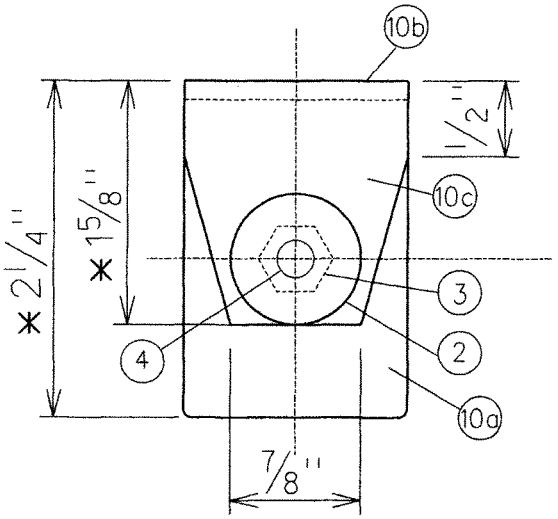
FIG. 4 is top sectional view of the bottom side of the present invention.
Figure 5:
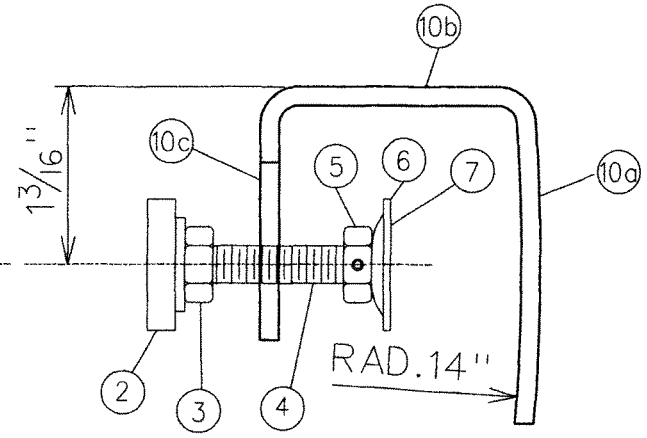
FIG. 5 is right side view of the present invention.
Figure 6:
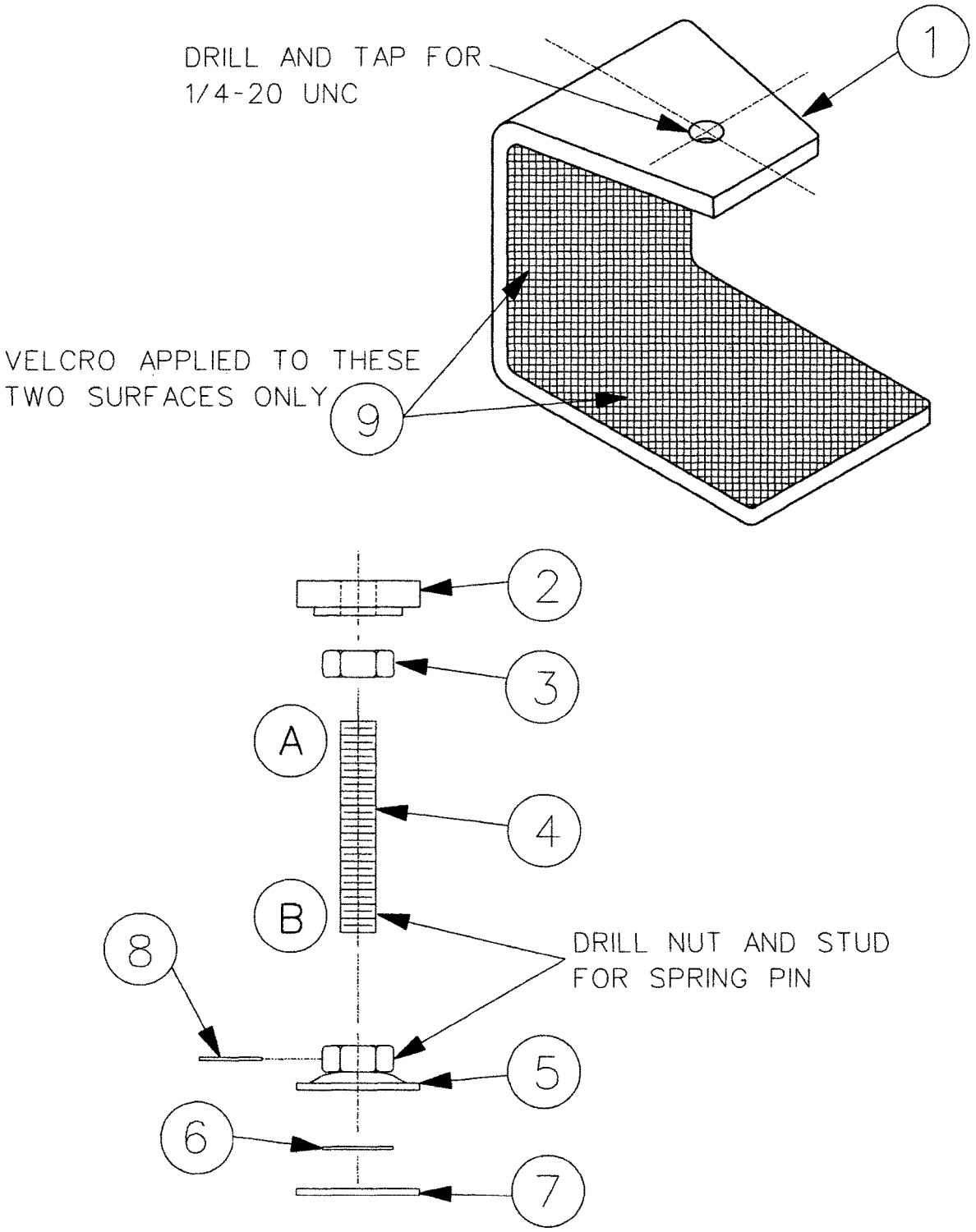
FIG. 6 is a view of the parts list of this present invention.

The following discussion describes the embodiment of this present invention. For a definition of the complete scope of the invention the reader is directed to the appended claims. FIGS. 1 through 6 illustrate the present invention wherein a capo for stringed instruments is disclosed and is illustrated by reference number 10. Turning to FIG. 1, therein is shown the capo 10 of the present invention mounted on the neck of a stringed instrument 14. The stringed instrument having a fret board 13, a plurality of frets 11, a nut 18, a headstock 17, tuning posts 16, tuning keys 15, an additional three tuning keys are located on the opposite side of headstock 17 (not illustrated), and a plurality of strings 12. Referring to FIG. 2 the capo 10. A body 1 and Velcro 9 lining the inside of body 1. The capo 10 of the present invention is shaped to have a front face which is in contact with the fret board of the neck of the stringed instrument, a top face in contact with the side neck of the stringed instrument and a rear face in contact with the rear portion of the neck of the stringed instrument. The rear face of the capo has a through hole for attachment of an adjustment assembly. The adjustment assembly of the capo 10 also includes knurled thumbnut 2, and a lock nut 3, in that order, to be attached to a threaded rod 4 place in the through hole of the rear face. Attached to the inside face of the rear face in which the threaded rod extends therethrough is a swivel washer 5 a spring pin 8, a spacer washer 6, and a circular piece of Velcro pad 7 sized to fit the spacer washer 6, are attached thereto in that order.

The capo 10 of the present invention, is intended for use on standard guitars 14 or the like, for changing the key that the instrument 14 is intended to be played in, e.g. from the key of G to the key of B. Compressing the strings 12 in the direction of the neck, to two adjacent frets 11, causes a shortening of the lengths of the strings 12. By shortening the lengths of the strings 12, a change in key can be achieved on guitar and other stringed instruments. While, in most existing capos, the strings 12 are compress downward to the fret board 13, causing an excessive rise in string 12 octave. The present invention allows, the capo to 10 only compresses the strings 12 to the frets 13, as opposed to the fret board 13, thereby preventing unwanted octave rise of the string 12. Additionally, the Velcro 9 that lines the inside of the capo body 1 rests on the strings 12, which will prevent movement of the strings 12 in a sideways or parallel direction in relation to the frets 11, Movement of the strings in a sideways or parallel direction also cases the strings the strings 12 to be out of tune. This present invention is unique in that when the capo 10 is placed over the neck 14 in a playing position, the usage of Velcro 9 allows the capo 10 to be used with a string instrument in a manner such that octave changes of the strings are eliminated thereby providing a more in tune string instrument. Further, the Velcro 9 limits movement of the strings in a parallel direction as explained above, to further providing a more in tune stringed instrument.

In addition to reducing the chances of the stringed instrument being out of tune as explained above, the capo of the present invention also allows convenient usage which is not offered by standard capo units. When the capo is placed on the neck of the stringed instrument in a playing position, the capo 10 can be moved up and down the neck 14 of the stringed instrument. The adjustment assembly placed on the rear face of the capo allows for single handed adjustment along the neck of the string instrument. With the arrangement and location of the adjustment assembly allows the user, with one hand and with one adjustment of the knurled thumb nut 2. By loosening the thumb nut 2 only, the capo can be lifted off the neck 14 when not needed. Most capos have straps that must be removed prior to installing, adjusting, or removing the capo, requiring two hands. The present invention allows the user to have easy and simple attachment of the capo 10, as well as easy adjustment and removal.

Turning to FIG. 2, therein shows an exploded view of the present invention 10 showing relation to the strings 12 of instrument 14 as illustrated in FIG. 1. The present capo 10 is assembled by installing the Velcro 9 on to the inside of the capo 10 body 1. A swivel washer 5 is screwed onto a ¼" 20 threaded rod 4 and pinned with a ⅜" spring pin 8. A ⅜" spacer washer 6 is installed on the ⅞" swivel washer 5, followed by pressing a circular Velcro pad having a ⅞" onto the ⅞" swivel washer 5. Next the assembled ¼" 20 threaded rod 4 as explained above is screwed through a ¼" 20 threaded hole 20 from the inside of body 1, then a ¼" lock nut 3 is screwed onto ¼" 20 threaded rod 4 followed by a ⅞" knurled thumbnut 2 that is screwed on the ¼" 20 threaded rod 4 and locked together with a ⅜" locknut 3.

The following paragraphs describe the detailed construction of the present invention 10 by referring to FIGS. 1-6. The body 1 of the capo 10 starts out as a bar, which the preferred embodiment has a rectangle shape, made from steel or other type of hard metal and is approximately ⅛" high by 1½" wide and approximately 5¼" long. As illustrated in FIG. 2 a 15½-degree chamfer 19 is cut from each side of the side of the rectangular bar 1, measured from a starting point on the end of the body 1, ⅜" from a center point on each side. The through hole for the ¼" 20 threaded rod 4 is then drilled from a center point and tapped for ¼" 20 thread approximately ⅜" from the end of the body 1. The next step is to bend a 14" radius on the underside of body 1, from the end of the capo body 1 that rest on the strings 12 in 2⅛" making a radius that contours to the instrument neck 14. Next, the rectangle bar 1 is sanded with 220 grit sandpaper, bottom, ends and sides. The body of the capo 10 is then bent at 90 degrees approximately 2⅛" from the end that covers the strings 12 and frets 11. Next, 1⅝" from this bend, the body 1 is bent again at 90 degrees that turns under the bottom side of the instrument neck 14. Next, the outside surface of the body 1 is sanded with 220 grit sandpaper. Next the Velcro 9 is applied to the inside of the body 1 to cover all surfaces of the inside of the body 1. Any excess Velcro 9 that extends from the sides of the body 1 is trimmed off. The next step is to cut the threaded rod 4 to 1½", then screw the ⅞" swivel washer 5 onto the threaded rod 4. Next, drill the swivel-nut 5 with a 3/32" drill bit and insert the ⅜"×3/32" spring pin 8. The ⅜" spacer washer 6 is placed next on to the ⅞" swivel-washer 5 to which a round piece of Velcro 7, ⅞" in diameter, is applied over the ⅜" spacer washer 6 to the ⅞" swivel washer 5. At this stage sanding the points of the locknut 3 for appearance can be done. Finally screw the ¼" threaded rod 4 into the drilled and tapped ¼" 20 threaded hole 20 from the inside. Next, screw the ⅜" lock nut on to the threaded rod 4, then screw on the ⅞" knurled thumbnut 2 and lock the two together. The above description, the preferred dimensions and construction of the capo of the present invention, however any dimensions that would allow the same performance could be considered.

With further reference to FIG. 1 to install the capo of the present invention 10 on to a stringed instrument such as a guitar or banjo neck 14 one should grasp the capo's body 1 by its sides with thumb and fingers, with the instrument 14 in a horizontal playing position, and lower the capo 10 downward onto the neck of the instrument 14. Tighten the ⅞" thumbnut 2 to a degree which allows the capo 10 to slide easily up and down the neck 14 of the instrument. Next, slide the capo 10 along the neck of the instrument to the position you wish to play in e.g. A. B. etc., Finally line the leading edge of the capo with the peak or center of the fret 11 and tighten the ⅞" knurled thumbnut 2 until the strings 12 are pressed firmly to the frets.

Again, the present embodiment of capo 10 provides the user with a device that is capable of being used without affecting the octaves of notes being played on a stringed instrument and thereby provides an instrument that is capable of being more in tuned. Further the construction of the device allows for easy maneuverability of the device along the neck of the instrument which can be performed using one hand, while at the same time providing enough tension to remain in place without forcing the strings to the fret board. The present invention can provide an appropriate tension to compress the strings to only the frets, as opposed to the fret board, thereby providing a capo to be used with string instruments which does not raise the octave of the strings to an unwanted level. The above description the preferred dimensions and construction of the capo of the present invention, however any dimensions that would allow the same performance could be considered.

What is claimed:

1. A capo to be used with stringed instruments having a neck comprising:

A body having a first, a second, and a third face; An adjustment assembly attached to the body; and Velcro connected to an inside surface of the body to be in contact with the neck of the stringed instrument when in use, wherein the body includes: A first face having a substantially rectangular shape, said first face is attached at an edge of the neck of the stringed instrument when in a horizontal playing position; A second face having substantially rectangular shape, has a 90-degree bend from the first face, said second face is in contact with a side of the neck of the stringed instrument when in a horizontal position; A third face having tapered edges at two sides, including a through hole, has a 90-degree bend from the second face, and is in contact with a back of said neck when in a horizontal playing position, and wherein the adjustment assembly includes; a knurled thumbnut, a lock nut, a threaded rod, a swivel washer, a spring pin, a spacer washer, and a Velcro pad, wherein the knurled thumbnut and lock nut are threaded at one end of the threaded rod, said threaded rod is connected in the through hole of the third face, and the swivel washer, spring pin, spacer washer, and Velcro pad are connected at the other end of the threaded rod.

2. The capo of claim 1, wherein the inside surface of the second face has Velcro lining.

3. The capo of claim 2, wherein the front face Velcro protects the strings and prevents parallel movements of the strings.

4. The capo of claim 1, wherein the inside surface first face has a Velcro lining.

5. The capo of claim 4, wherein the Velcro lining protects the inside of the instrument neck.

6. The capo of claim 1, wherein the knurled thumbnut is an adjustable knob.

7. The capo of claim 6, wherein when the adjustable knob is tightened at the third face, the first face is pulled towards the strings.

8. The capo of claim 1, wherein the body is a rectangular bar having two 90-degree bends forming a u-shape.

9. The capo of claim 8, where the body is made of 304 stainless steel.

10. The capo of claim 8, wherein the body in its rectangular form has a height of ⅛", a width of 1½", and a length of 5¼".

11. The capo of claim 10, wherein a 15½" degree chamfer is cut off each side of one end of the rectangular bar, measured from a starting point on the end of the body ⅜" from a center point on each side.

12. The capo of claim 11, wherein the through hole of the third face is drilled from a center point approximately ⅜" from the end of the body.

13. The capo of claim 12, wherein a 14" radius bend is on the underside of the body of the front face, and wherein the 14" radius contours to the instrument neck.

14. The capo of claim 13, wherein the body of capo is first bent at a 90-degrees approximately 2⅛" from the end of the front face.

15. The capo of claim 14, wherein 1⅝" from the first bend, the capo is bent a second time at a 90-degrees, allowing the capo to fit a back side of the instruments neck.

* * * * *